United States Patent [19]

Stubbings

[11] 4,257,548

[45] Mar. 24, 1981

[54] FASTENING USING AIR HAMMER

[75] Inventor: James H. Stubbings, Rockville, Md.

[73] Assignee: Potomac Applied Mechanics, Inc., Bethesda, Md.

[21] Appl. No.: 40,310

[22] Filed: May 18, 1979

Related U.S. Application Data

[63] Continuation-in-part of Ser. No. 873,969, Jan. 31, 1978, Pat. No. 4,184,357, which is a continuation-in-part of Ser. No. 833,338, Sep. 14, 1977, Pat. No. 4,183,239.

[51] Int. Cl.[3] ..... B25C 7/00

[52] U.S. Cl. ..... 227/8; 227/55; 227/112; 227/117; 227/136

[58] Field of Search ..... 72/391; 227/8, 51, 53, 227/55, 112, 117, 130, 136

[56] References Cited

U.S. PATENT DOCUMENTS

| | | | |
|---|---|---|---|
| 2,445,674 | 7/1948 | Kendall | 227/112 |
| 2,707,277 | 5/1955 | Aldrich | 227/112 |
| 3,056,965 | 10/1962 | Rogers | 227/8 |
| 3,233,523 | 2/1966 | Passaggio | 91/54 |
| 3,672,029 | 6/1972 | Butriss | 227/112 |
| 3,724,738 | 4/1973 | Hurst | 227/147 |
| 3,979,039 | 9/1976 | David | 227/60 |
| 4,089,099 | 5/1978 | Nivet | 72/391 |

*Primary Examiner*—John McQuade

*Attorney, Agent, or Firm*—Cushman, Darby & Cushman

[57] ABSTRACT

A plurality of two-piece fasteners are connected together by frangible plastic and are automatically fed past moveable wall portions to an area where they are in operative position to be acted upon by impacting pistons. A first inner and a second, outer, concentric pistons are provided, the second piston driving the outer component of the two-piece fastener through metal sheets to be connected together, and the first piston driving the inner fastener component. A common actuating piston may be provided for driving the first and second pistons, with the magazine for the fasteners connected up to the low pressure side of the common piston. It is not possible to fire the impacting device until a handle thereof has been rotated against spring pressure and the bottom thereof is in contact with the work.

18 Claims, 20 Drawing Figures

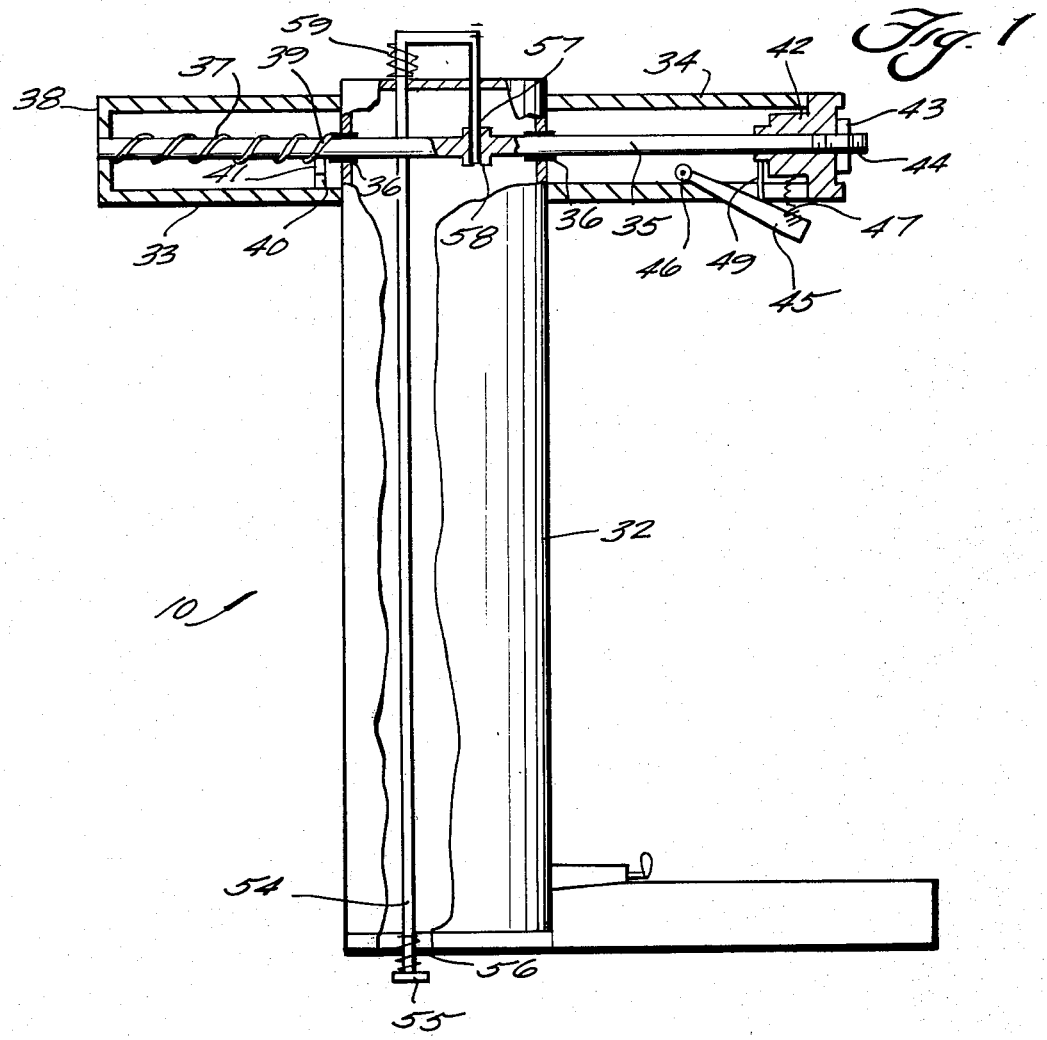
Fig. 2
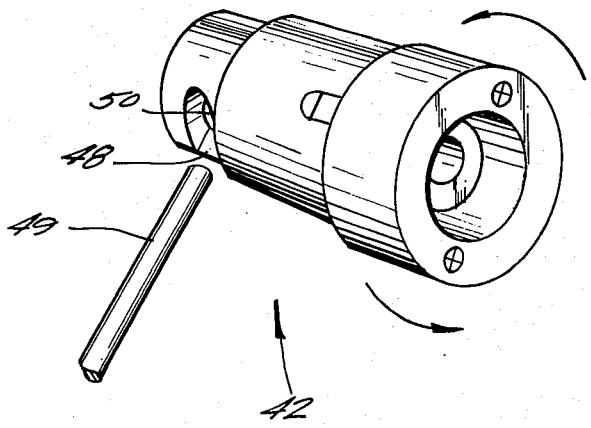

MAGAZINE
VENT
P
V
A
F

FASTENING USING AIR HAMMER

CROSS REFERENCE TO RELATED APPLICATIONS

This application is a continuation in part of application Ser. No. 873,969 filed Jan. 31, 1978, now U.S. Pat. No. 4,184,357; which in turn is a continuation in part of application Ser. No. 833,338, filed Sept. 14, 1977, now U.S. Pat. No. 4,183,239.

BACKGROUND AND SUMMARY OF THE INVENTION

A general concept of utilizing a dual piston impacting device for driving self-piercing two-piece fasteners to attach work pieces together is shown in U.S. Pat. No. 3,724,738. According to the present invention, a powered impacting device is provided that allows automatic feeding of fasteners to a dual piston impactor for rapid interconnection of work pieces that are to be connected, and which provides for such rapid fastening in a safe and reliable manner. Also, a method is provided which allows automatic feeding of interconnected two-piece fasteners for rapid utilization thereof in interconnecting work pieces together and which effects such interconnections utilizing pneumatic force application. In practicing the method, a plurality of two-piece fasteners are provided which are interconnected by frangible connectors, the outer component of each fastener having a head at one end thereof and two distinct tip portions at the other end thereof with the frangible connector having an encircling portion surrounding the body of the outer fastener component midway between the tip portions and the enlarged head, and having substantially the same diameter as the enlarged head.

It is the primary object of the present invention to provide for automatic feeding of two-piece selfpiercing fasteners to a simple, effective powered impacting device. This and other objects of the invention will become clear from an inspection of the detailed description of the invention, and from the appended claims.

BRIEF DESCRIPTION OF THE DRAWINGS

FIG. 1 is a schematic view partly in cross-section and partly in elevation of an exemplary impacting device according to the invention;

FIG. 2 is a perspective view of a cam portion of the handle of the device of FIG. 1 for selectively blocking or allowing trigger movement;

DETAILED DESCRIPTION OF THE DRAWINGS

Figure 3A:
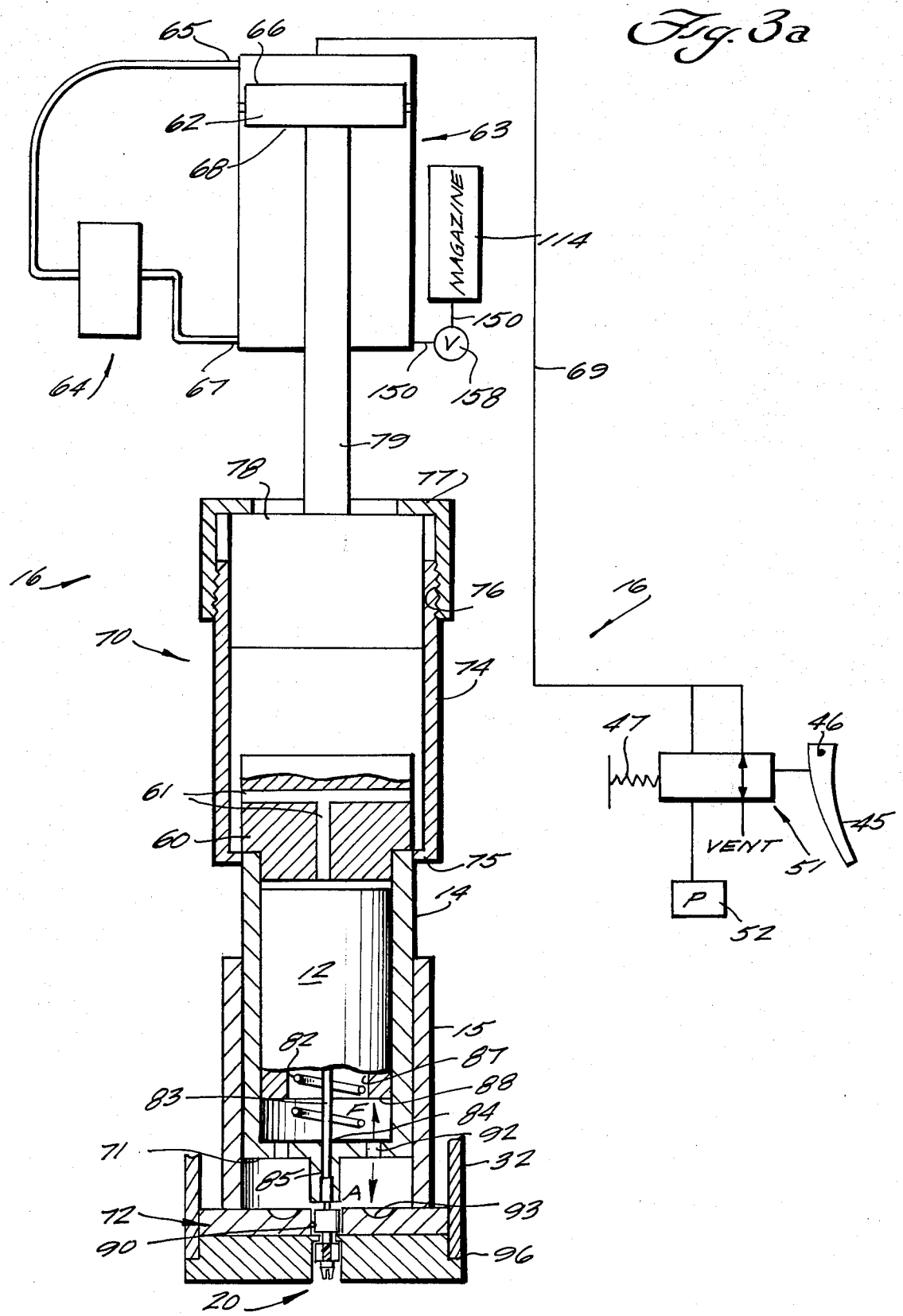
FIG. 3*a* is a diagrammatic showing of the actuating component parts of a preferred embodiment of the device according to the invention.

The exemplary powered impacting device shown generally at 10 in FIG. 1 is similar to the impacting devices illustrated and described in parent application Ser. No. 873,969, now U.S. Pat. No. 4,184,357 the disclosure of which is hereby incorporated by reference herein. The powered impacting device basically includes a first, inner driving piston 12 (see FIG. 3*a*) concentric with a second, outer driving piston 14, the second piston 14 being guided in a cylinder 15. Means 16 (see FIG. 3*a*) are provided for operatively supplying pressurized actuating fluid (preferably pneumatic fluid) so that the pistons 12, 14 will be operated to move in direction A to drive the outer component 22 of a two-piece fastener assembly 20 (see FIGS. 8*a* through 9*e* in particular) so that it pierces a previously solid metal sheet, and then to drive the fastener inner component 21 to effect attachment of the outer component in operative association with the metal sheets being pierced (see FIG. 9*e* where sheets B, C and D are interconnected).

The device 10 illustrated in FIG. 1 includes a body portion 32 and first and second handles 33, 34 for gripping by the operator of the device 10 during utilization thereof. The body 32 supports the cylinder 15 and all the accessory operative components, while the handles 33, 34 allow for grasping by the operator. Safety mechanisms are associated with the device 10, including the handles 33, 34, to prevent actuation of the pistons 12, 14 except under specific conditions. In this regard, a handle safety mechanism is provided for effectively preventing operative supply of actuating fluid to the pistons 12, 14 unless the handle 33 is positively rotated against spring pressure. Such handle safety mechanism includes the handle 33 which has an interior shaft 35 passing therethrough and through the handle 34, mounted by bushings 36 which are affixed to the housing 32. A torsion spring 37 or the like is connected at one end 38 thereof to the handle 33, and at the other end 39 thereof to the stationary housing 32 and provides the spring pressure rotatively urging the handle 33 to a given position. Cooperating stops 40, 41 may be provided on the interior of the handle 33 and on the housing 32, respectively, to stop handle rotation at given angular orientations.

The handle safety mechanism further comprises a cam portion 42 attached to the shaft 35 (as with nut 43 engaging the screw threaded end 44 of shaft 35) and rotatable with the shaft 35. The cam portion 42 operatively engages the trigger 45 to prevent pivotal movement of the trigger 45 about pivot 46 in one position of the cam portion 42, and to allow movement of the trigger 45 in another position of the cam portion 42. A spring 47 normally biases the trigger 45 to the position indicated in FIG. 1. Such selective movement preventing or providing is accomplished by the tapered surface 48 of cam portion 42 which abuts pin 49 associated with the trigger 45, and bore 50 formed in cam portion 42. The pin 49 will normally abut tapered portion 48, but as cam portion 42 is rotated in the direction of the arrows in FIG. 2 (by rotation of the shaft 35 by turning handle 33 against the pressure of spring 37) the bore 50 will come in alignment with the pin 49. With the bore 50 in alignment with pin 49, the trigger 45 may be depressed against the bias of spring 47 to an inward position to allow operation of a valve 51 (see FIG. 3*a*) which allows actuating fluid from a high pressure source 52 to be operatively supplied to the pistons 12, 14.

A further safety mechanism associated with the device 10 includes safety means for preventing operative supply of actuating pressurized fluid to the pistons 12, 14 unless the device 10 is in contact with the surface into which the fasteners are to be driven. Such safety means preferably includes a rod 54 having a foot 55 at one end thereof extending outwardly from the barrel of the device 10 for engaging the work being recessed into the bottom of the casing 32 and having a spring 56 for biasing the foot 55 outwardly, and a second end 57 of the rod 54 for cooperation with a bore 58 passing through shaft 35. A spring 59, lighter than the spring 56, may be provided for facilitating positive movement of the end 57. When the foot 55 is pressed into engagement with a surface into which fasteners are to be driven, the rod 54 is moved upwardly against the bias of spring 56 (see FIG. 1) so that the end 57 thereof is moved out of the bore 58, allowing rotation of the shaft 35 by turning of the handle 33. When the device 10 is moved out of engagement with the surface into which fasteners are to be driven, the foot 55 is returned under the bias of spring 56 to a downward position and the end 57 is moved downwardly to pass through the bore 58 in shaft 35, preventing rotation of the shaft 35.

Operative actuation of the pistons 14, 12 is preferably provided by the apparatus 16 schematically illustrated in FIG. 3*a*. Apparatus 16 preferably includes a third piston 60 in abutting engagement with second piston 14 (it may be ridgedly attached thereto), with the first piston 12 axially moveable with respect to the third piston 60. A vent passageway 61 is provided the third piston 60 to allow gas to flow from between the first and third pistons 12, 60 upon relative axial movement therebetween. A fourth, common actuating, piston 62 is also provided, forming part of a piston and cylinder arrangement 63. The piston and cylinder arrangement 63 preferably is a Scharader Pow-Air-Pak piston (such as shown and described in U.S. Pat. No. 3,233,523, the disclosure of which is hereby incorporated by reference herein). A quick exhaust shuttle valve means 64, such as a Schrader No. 3340 quick exhaust shuttle valve is also associated with assembly 63, having one end 65 thereof connected up to the side of the assembly 63 in which the high pressure face 66 of the piston 62 is disposed, and having the other end 67 thereof connected up to the side of the assembly 63 with which the low pressure face 68 of the piston 62 is operatively associated. The quick exhaust shuttle valve means 64 effects quick pneumatic actuation and automatic return of the piston 62. High pressure pneumatic fluid is provided through the line 69 to the assembly 63, as indicated in FIG. 3*a*, from the high pressure source 52 by actuation of the valve 51 by effecting pivotal movement of the trigger 45.

Lost motion connecting means 70 are provided for operatively interconnecting the fourth 62 and second 14 pistons so that upon movement of the fourth piston 62 to its original position (as shown in FIG. 3*a*) spaced from the second piston 14, the second piston 14 will be moved so that the end face 71 thereof is operatively spaced from the end face structure 72 of the cylinder 15. This lost motion connecting means 70 preferably comprises a tube 74 having a flange 75 at one end thereof for abutting the third piston 60, which is rigidly attached to the second piston 14, and having screw threads 76 formed at the other end thereof for receipt of cooperating screw threads formed on a flanged collar 77 for engaging an enlarged termination 78 of the piston rod 79 connected to the fourth piston 62.

Figure 3B:
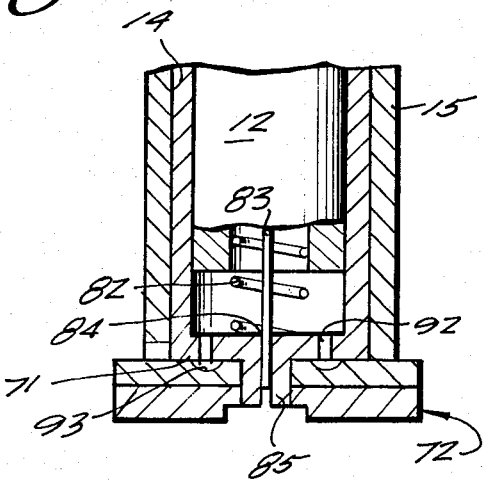
FIGS. 3*b* and 3*c* are schematic showings of successive steps of operation of the FIG. 3*a* piston assembly.
Figure 3C:
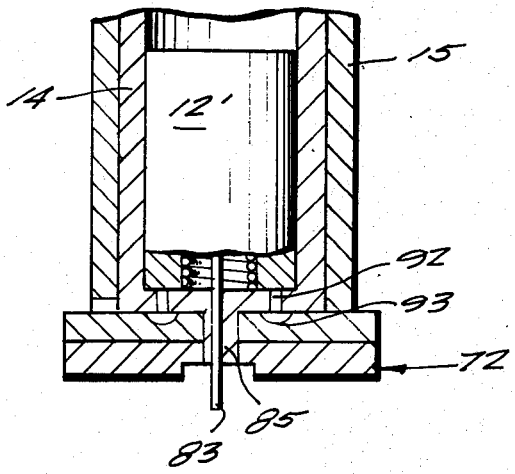

As shown in FIGS. 3*a* through 3*c*, the second piston 14 preferably defines a cylinder for guiding movement of the first piston 12, and biasing means such as spring 82 are provided for biasing the first piston 12 in direction F (see FIG. 3*a*) with respect to the second piston 14. The first piston 12 is massive enough so that upon termination of movement of the second piston 14 under the influence of the actuating fluid (provided by the hammer impact of the enlarged termination 78 of the piston rod 79) the first piston 12 will continue movement in the axial direction A against the bias coil spring 82 until positively stopped, as by the top surface of the end face 71 of the piston 14. The first piston 12 includes a circular cylindrical extension 83 with the end face 71 of the second piston 14 having a concentric opening 84 formed therein for receipt of the extension 83, and having a tubular extension 85 thereof concentric with the opening 84. Extension 83 extends past extension 85 when the piston 12 is moved into operative engagement with the end face 71 of piston 14. Preferably the spring 82 is disposed in a bore 87 formed in the piston 12 so that the end face 88 of piston 12 can abut the top surface of the end face 71 of second piston 14. The extension 85 is long enough to drive the outer component of the fastener 20 received by the end face structure 72 into operative association with sheet metal pieces to be fastened together.

Air between the end face 71 of piston 14 and the end face structure 72 of the casing 32 may be vented through the bore 90 in the end face structure 72 holding the fastener 20. Air between the piston 12 and the end face 71 is vented through one or more holes 92 formed in end face 71 and spaced from the concentric opening 88, and also by one or more grooves 93 formed in the top of the end face structure 72. FIGS. 3*a* through 3*c* show the sequential operation of the pistons 12, 14 to effect fastening.

Figure 4B:
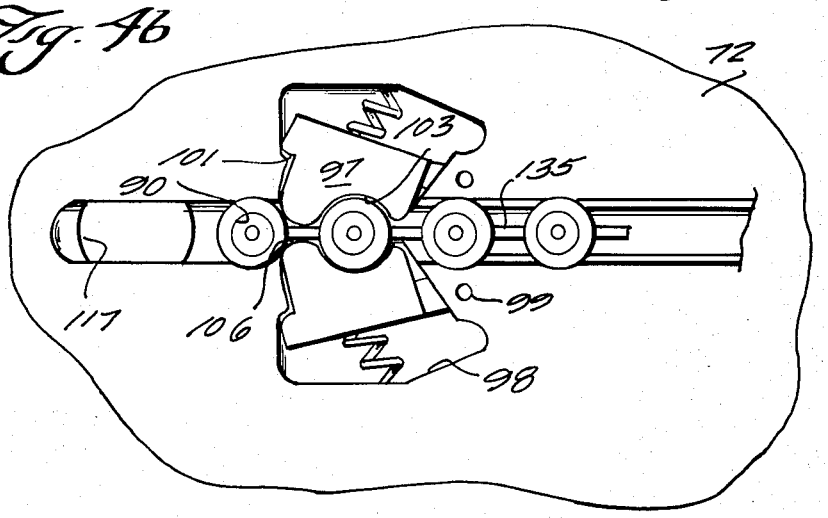
FIG. 4*b* is a schematic showing of the moveable wall portions of the FIG. 4*a* device showing a string of fasteners in operative association therewith and FIG. 4*c* is a cross-sectional view of the end structure of FIG. 4*a;*
Figure 4C:
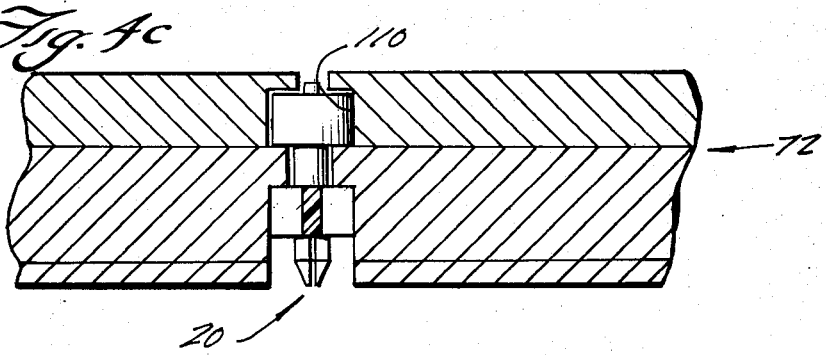
Figure 4A:
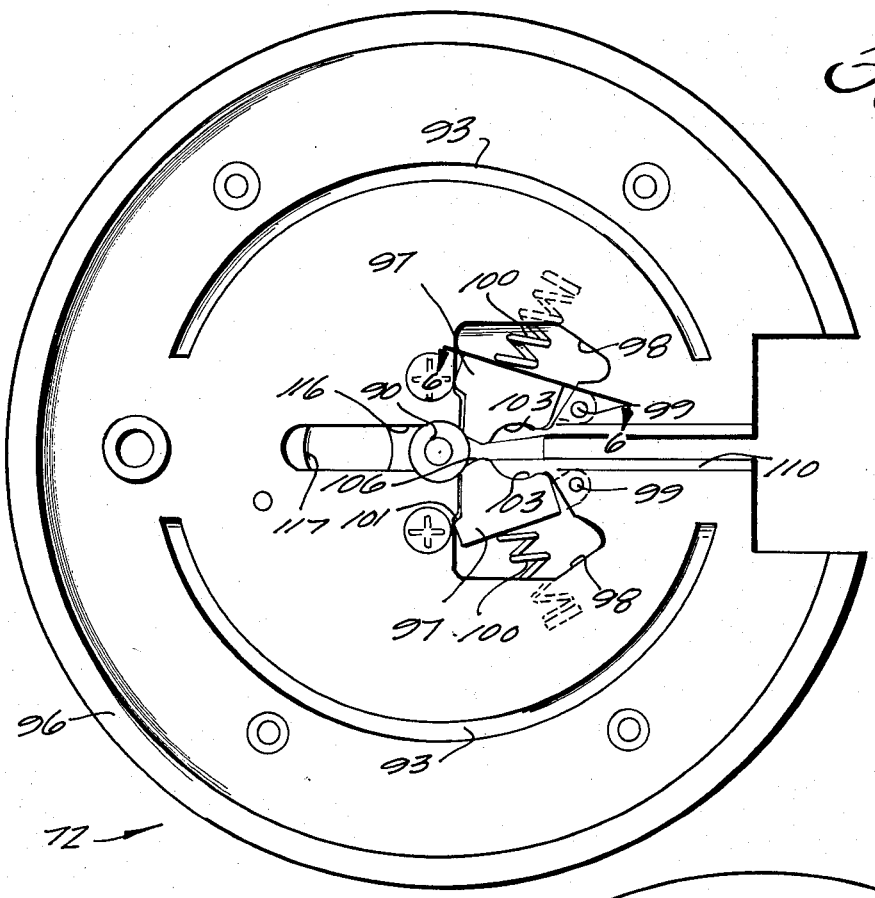
FIG. 4*a* is a top plan view of the end face of the device of FIGS. 1 and 3*a*.
Figure 5:
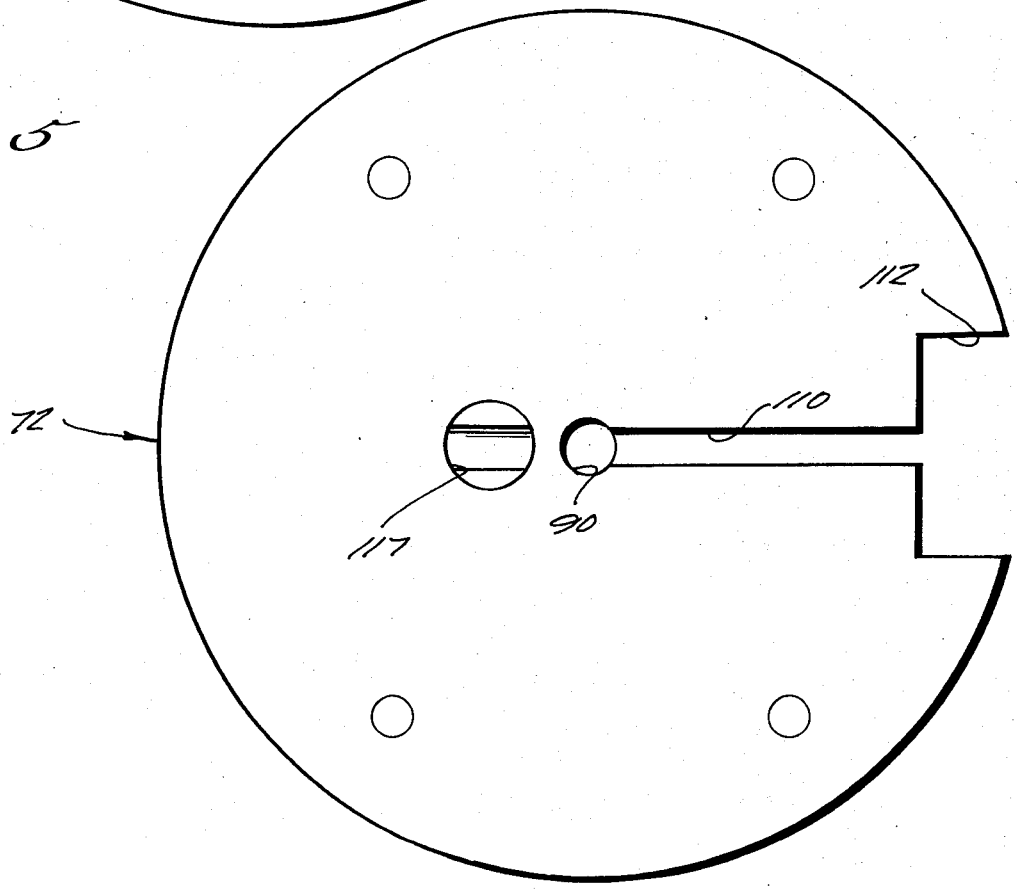
FIG. 5 is a bottom plan view of the end face of FIG. 4*a;*

The end face structure 72 of the device 10 is operatively connected to the rest of the device 10 so that the lip 96 thereof abuts the bottom of the casing 32 (see FIG. 3*a*); the details of the structure 72 are shown most clearly in FIGS. 3*a*, 4*a* and 5. As illustrated in FIGS. 4*a* and 4*b*, a pair of moveable wall portions 97 for receiving two-piece fasteners 20 in cooperation with the bore 90 in the structure 72 are provided, the moveable wall portions 97 being mounted in cut-outs 98 formed in the structure 72 adjacent the bore 90. The bore 90 is, of course, disposed in alignment with the piston 12, 14 fastener abutting portions 83, 85, which penetrate the bore 90.

Figure 6:
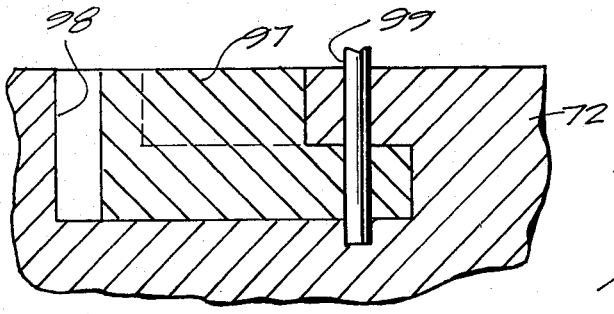
FIG. 6 is a cross-sectional view indicating the pivotal connection of one of the moveable wall portions of FIG. 4*a* to the end face, taken along lines 6—6 of FIG. 4*a;*

Preferably the moveable wall portions 97 are pivotally moveable about pivot points 99 (see FIGS. 4*a* and 6 in particular), springs 100 biasing the portions 97 so that they normally are in a first position (as illustrated in FIG. 4*a*) where they are spaced only slightly from each other, but are moveable against the bias of springs 100 to a second position where they are spaced widely from each other, wide enough to allow the passage of a fastener 20 therepast. In the first position thereof, stop portions 101 thereof engaged cooperating stop portions formed in the structure 72 by the cutout 98 so that the portions 97 are spaced a distance corresponding to the approximate width of the frangible connector interconnecting the fastening components 20 (as will be more fully described hereinafter).

The moveable wall portions 97 include cam means 103 formed in portions thereof located between parallel planes passing through the pivots 99 and substantially equi-distance from, and disposed on either side of a line extending through the bore 90 perpendicular to the end face structure 72. The cam portions 103 correspond generally in shape to the substantially circular head 105 of a fastening component 20 to be received thereby (see FIGS. 9*a* through 9*e*). Also, the wall portions include portions 106 thereof that form a circumferential extent of the bore 90 to properly position a fastener 20 in place to be impacted by the pistons 12, 14. FIG. 4*b* illustrates an end fastener being engaged by the portions 106 while the next fastener in a string of fasteners is being received by the cam portion 103.

The cut-outs 98 are preferably completely contained within the circumferential extent of the end face structure 72 as illustrated in FIGS. 4*a* and 4*b*. The moveable wall portions 97 are always disposed radially outwardly of the second piston 14 fastener abutting portion 85 so as never to engage said portion 85, merely forming border portions of the bore 90 with the surfaces 106 thereof.

The end face structure 72 further includes a substantially radial grooved passageway 110 shaped to receive a fastener 20 therein, as illustrated in FIG. 4*c*. Also, a cut-out portion 112 is provided for receipt of a magazine 114 (see FIG. 7*a*) therein, the radial groove 110 having a groove configuration substantially the same as the guiding portions of the magazine 114 (compare FIGS. 4*c* and 7*b*). Also, means are provided for defining a passageway 116 operatively communicating with the bore 90 to allow passage away from the bore 90 of frangible connector material associated with the fasteners 20, so that such frangible connector material passes out of the end structure 72 through the opening 117 or the like.

The two-piece fasteners according to the present invention are shown most clearly in FIGS. 8*a* through 9*e*. Each fastener includes an outer component 22 and an inner component 21, the outer component 22 having a body portion with an enlarged head 105 formed at one end thereof, and two distinct tip portions 120 formed at the opposite end thereof, the two tip portions 120 having outer surfaces slopping toward each other so that the outer component tip is pointed. Cam engaging interior portions 121 are provided for engaging the generally pointed distal tip cam surface means 122 of the interior portion 21.

Figure 9A:
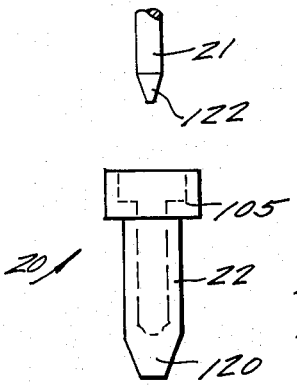
FIGS. 9*a* through 9*e* are schematic showings of details of the fasteners in the strings of FIGS. 8*b* and 8*c*, FIG. 9*b* being the same as FIG. 9*a* only showing the outer component rotated 90°, FIG. 9*c* being a cross-sectional view showing the relationship between the inner and outer components before impacting thereof, FIG. 9*d* being a cross-sectional view of a modified form of the FIG. 9*c* fastener, and FIG. 9*e* showing the components attaching several pieces of material together.
Figure 9B:
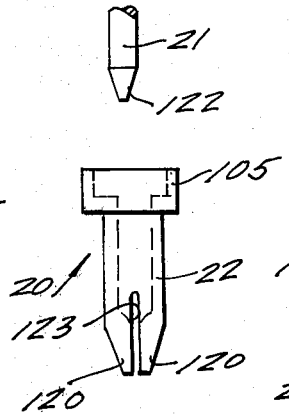
Figure 9C:
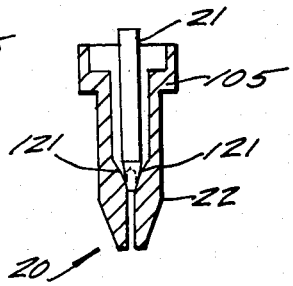
Figure 9D:
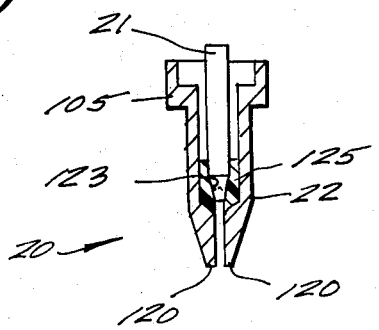
Figure 9E:
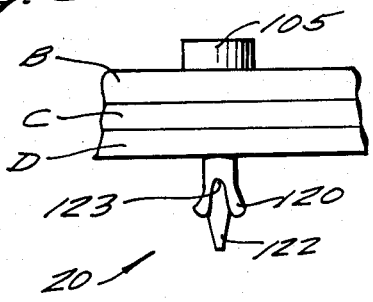

The distinct tip portions 120 are defined by grooves 123, the grooves 123 extending a sufficient distance along the body of the outer component 22 so that the outer component 22 will penetrate the desired thickness of material to be fastened together without splitting, and so that the tip portions 120 may be moved radially outwardly by the inner component 21 a sufficient distance to effect fastening of the material together, as illustrated in FIG. 9*e*. Normally, when the components 21, 22 are together in position for operative use thereof, the grooves 123 will extend to a terminating position just above the cam surface 122 of the inner component 21, as illustrated most clearly in FIGS. 9*c* and 9*d* (see dotted line configuration of groove 123).

In embodiments where the pieces to be fastened together (e.g. sheets B, C, and D) are duct work pieces, it may be desirable to insure that no air can pass past the fastener components from inside the duct to the exterior thereof. This may be accomplished by providing a deformable material 125 (see FIG. 9*d*) between the first and second components 21, 22 for providing airtight sealing therebetween upon completion of relative movement therebetween. Alternatively, the inner component 21 may be provided with an enlarged head 126 as illustrated in the FIG. 8*a* embodiment, for sealing with the outer component 22 in substantially airtight engagement after relative movement therebetween.

For automatic feeding of fasteners according to the present invention, an assembly or string of fasteners is provided with frangible connector means 130, such as frangible plastic, being provided operatively connecting consecutive fasteners together. Preferably, a hard, breakable plastic will be provided connecting outer component 22 of consecutive fasteners together. In the embodiment illustrated in FIG. 8*a*, encircling portions 131 of the connector means 130 are formed with feathers for engaging riflings in a bore with which they are used (such as bore 90) and a similar feather link 132 is associated with inner component 21. In the preferred embodiment of FIGS. 8*b* and 8*c*, however, the connector means includes an encircling portion 134 encircling the body portion of the outer component 22 at the end termination of the grooves 123, and having substantially the same peripheral extent as the enlarged head 105. Preferably, both the enlarged head 105 and the encircling portion 134 are circular, having substantially the same diameter so that both the head 105 and the encircling portion 134 are engaged at the same time by the moveable wall portions 97. Thinned portions 135 are provided interconnecting the encircling portions 134, the portions 135 having substantially the same width as the spacing between the moveable wall portions 97 in the first position thereof (see FIG. 4*a* and FIG. 4*b*).

The connectors 20 illustrated in FIGS. 9*a* through 9*e* may be constructed from conventional solid hex-head fasteners by boring a first, relatively small hole through the entire length of the fastener, boring a relatively larger hole (slightly larger than the diameter of the member 21) up until the cam portions 121 are formed, and then forming the grooves 123 with a saw and cutting the grooves to the proper depth (as illustrated in FIGS. 9*c* and 9*d*). The length of the inner components 21 is chosen so that the fasteners may readily be fed automatically into association with the bore 90, yet are long enough that when actuated by the piston portion 83 properly cam the tips 120 outwardly, as illustrated in FIG. 9*e*.

Figure 8A:
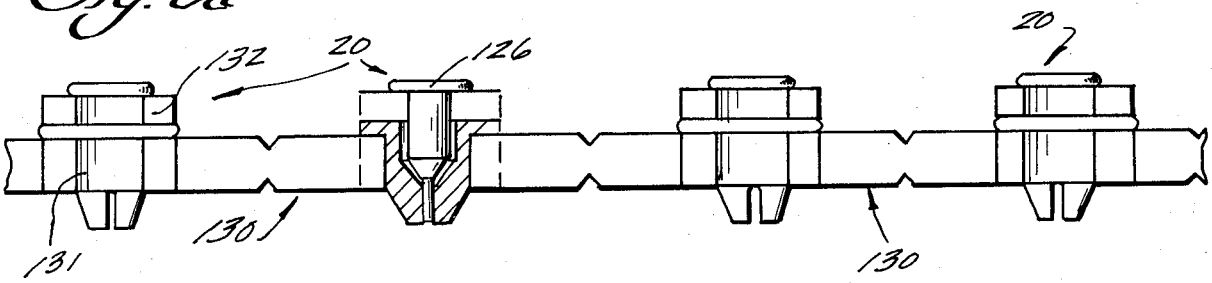
FIG. 8*a* is a side view of a string of interconnected fasteners according to the invention.
Figure 8C:
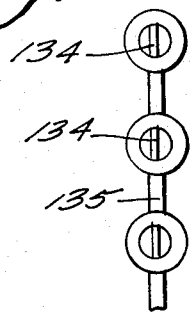
FIG. 8*c* is a bottom plan view of the string of FIG. 8*a;*
Figure 8B:
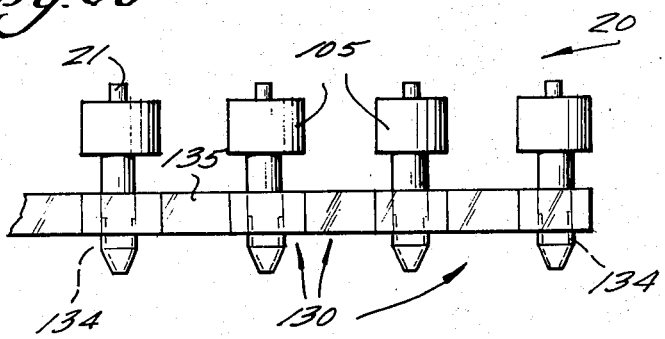
FIG. 8*b* is a side view of a modified string of fasteners.

The fasteners may be attached together in a string as illustrated in FIGS. 8*b* and 8*c* by disposing them in a mold and injecting a suitable plastic into the mold, allowing the plastic to harden and then removing the mold.

Figure 7B:
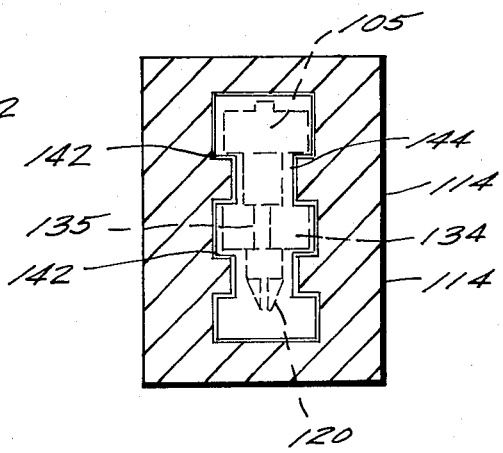
FIG. 7*b* is a cross-sectional view of the magazine of FIG. 7*a* taken along lines 7*b*—7*b* of FIG. 7*a;*
Figure 7A:
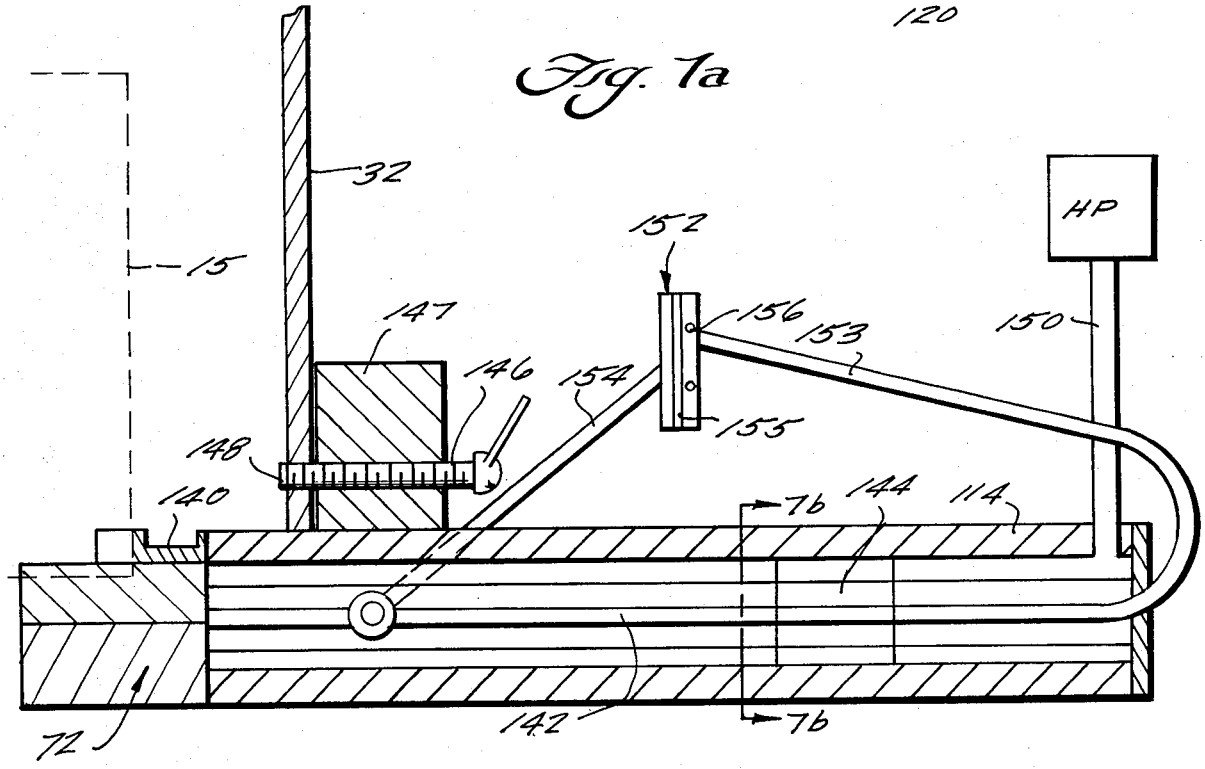
FIG. 7*a* is a schematic cross-sectional view of an exemplary magazine assembly for feeding fasteners according to the invention.

Automatic feeding according to the present invention is accomplished by utilizing the magazine 114 or the like, which is shown in greatest detail in FIGS. 7*a* and 7*b*, with an exemplary interconnection thereof to other components being illustrated in FIG. 3*a*.

The magazine 114 fits into the slot 112 formed in the end structure 72, with an arm 140 thereof extending up to and abutting the exterior of the cylinder 15. A guide track 142 is disposed interiorally of the magazine 114 and has substantially the same configuration as the passageway 110 (see FIG. 4*c*) formed in the end structure 72. A shuttle 144 is disposed in the guide track 142 and has substantially the same cross sectional configuration as the guide track 142, and is adapted to abut and move the fasteners disposed in the magazine 114, as most clearly illustrated in FIG. 7*b*. The magazine 114 may be connected in place to the casing 32 with the bolt 146 passing through the upstanding portion 147 of the magazine 114, and the threaded opening 148 in the casing 32 side wall.

Gas under pressure is supplied through line 150 to the end of the magazine 114 to act upon the shuttle 144, moving the shuttle toward the end structure 72 and causing it to impact the fasteners in the string disposed in the magazine 114. In order to prevent the fasteners from jamming up at the exit end of the magazine 114, a pair of detented wheels may be provided having cutouts formed in the periphery thereof for receipt of fasteners to facilitate one-by-one movement of the fasteners therepast. Alternatively, a quick exhaust shuttle valve means 152, such as a Schrader No. 3340 quick exhaust shuttle valve (similar to the quick exhaust means 64 associated with fourth piston 62) may be provided, connected up by lines 153 and 154 to the magazine 114 at opposite ends of the shuttle 144 as illustrated in FIG. 7*a*. The quick exhaust shuttle valve means conventionally includes a diaphragm pressed by a spring, shown schematically at 155 and 156 respectively in FIG. 7*a*.

The line 150 is operatively connected to the high pressure source 52 for actuating the pistons 12, 14. A preferred manner that this can be accomplished according to the present invention is illustrated schematically in FIG. 3*a*, the pressure conduit 150 being connected up to the cylinder assembly 63 on the low pressure side of the fourth piston 62 with a check valve 158 disposed in the conduit 150, the check valve allowing passage of gas from the assembly 63 towards the magazine 114, but not from the magazine 114 to the cylinder assembly 63. Thus, as piston 62 moves downwardly in direction A in FIG. 3*a*, the air compressed by the low pressure face 68 thereof will, in part, pass through the conduit 150 and check valve 158 to the magazine 114 to actuate the shuttle 144 so that after the pistons 12, 14 have been actuated to fire the fastener within the bore 90, and have been returned, the shuttle 144 will automatically force the next fastener of the string into place in the bore 90, moving past moveable wall portions 97 by engaging cam surfaces 103 thereof so that they move outwardly, until in-place in the bore 90, with the next fastener in the string in place engaging the faces 103 with the moveable wall portions closed (the FIG. 4*b* position).

By practicing the method of the present invention it is possible to fasten together two or more pieces of metal which do not have pre-drilled holes, utilizing pneumatic pistons. [Suitable electrically actuated impactors, or the like, may be provided as equivalents to such pneumatic actuators]. This may be accomplished with an automatic feed of fasteners to the impacting assembly so that rapid successive fastenings may be accomplished, and suitable safety means are provided to prevent careless operation of the device.

OPERATION

A plurality of two-piece fasteners 20 are formed and interconnected by frangible plastic connectors 130. A string of the fasteners are inserted in the guide track 142 of the magazine 114, pushing the shuttle 144 toward the end of the magazine 144 and with the head 105 and encircling portion 134 of the connector 130 being guided by the guide track 142 of the magazine 114. The magazine 114 is then inserted in place in the slot 112 of the corresponding opening in the casing side wall 32, and bolt 146 fastens the magazine 114 in place. The device 10 is then connected up to a high pressure source 52 of gas, such as a conventional pneumatic line from an air compressor, using conventional coupling hoses.

The device 10 is then primed for use by blank firing it once so that high pressure gas will move through the line 150 into the magazine 114 and cause the first fastener of the string to be forced past the moveable wall portions 97 into the bore 90, so that the structure is in the position generally indicated in FIGS. 3*a* and 4*b*. The device 10 is now ready for actual fastening use.

The end structure 72 of the device 10 is pressed into contact with top metal sheet B of the sheets to be fastened together, which causes the foot 55 to be depressed against the pressure of spring 56 and thereby causes the end 57 of rod 54 to move out of interferring engagement with the bore 58 of shaft 35. The operator then rotates shaft 33 against the pressure of torsion spring 37 until the pin 49 of the trigger 45 is in alignment with the opening 50 in cam portion 42 attached to shaft 35. Then the trigger 45 may be actuated, pivoting about pivot point 46 to actuate valve means 51 to connect line 69 up to the high pressure source 52. High pressure fluid is then applied to the high pressure face 66 of fourth piston 62 causing the piston 62 to move rapidly downwardly (in direction A) to impact the top of third piston 60 which in turn causes rapid movement in direction A of the second piston 14 causing the outer component 22 of the fastener 20 in the bore 90 to pierce the metal sheets B through D. The piston 12, being massive enough to continue movement against the pressure of spring 82 once the downward movement of the piston 14 is stopped, continues movement so that the cylindrical extension 83 thereof pushes the inner fastener component downwardly so that the cam portion 122 and the tip of the inner component 21 engages the cam portion 121 in the interior of the outer fastener component 22 to cause the tips 120 to flare outwardly and positively lock the fastener components in place as illustrated in FIG. 9*e* with the head 105 being provided pressing the plate B and the tip portions 120 being provided pressing the plate D.

During downward movement of the pistons 14, 12, the air between the face 71 of piston 14 and the end structure 72 is vented through the bore 90, and the air between the piston 12 and the end face 71 is vented through the openings 92 into the grooves 93 in the end structure 72. At the same time, air compressed by the low pressure face 68 of piston 62 passes through check valve 158 in conduit 150 to the magazine 114 to cause the shuttle 144 to move against the fasteners to push the next fastener in the string in place in the bore 90 once the pistons 12, 14 are returned.

Quick, automatic return of the piston 62 is effected by the quick exhaust shuttle valve 64. As the piston 62 returns, the end structure 78 connected to rod 79 thereof moves upwardly away from the third piston 60 until it engages collar 77, thereafter moving collar 77 upwardly and—with lost motion—the collar 75 engaging the periphery of the third piston 60 and thereby moving the second piston 14 upwardly. The spring 82 causes the first piston 12 to return to its original position, and any gas to be vented during the relative movement of the piston 12 with respect to the third piston 60 is passed through vent passageway 61. With the quick return of the pistons 14, 12 the next fastener in the string cams the moveable wall portions 97 outwardly about pivot points 99 against the bias of springs 100 until it is in place in the bore 90, whereby the wall portions 97 move towards each other under the bias of springs 100 to hold the next fastener in the string with the cam portions 103 thereof (FIG. 4*b*). The quick exhaust shuttle mean 152 effects return of the shuttle 144 so that the fasteners in the string would positively be fed one at a time with necessary driving force provided by shuttle 144.

The frangible connector associated with the fastener 20 in the bore 90 was shattered by downward movement of the piston 14, and fragments thereof passed through the passageway 116 in opening 117 out of interferring relationship with the device 10 components. The entire connector encircling portion 134 was fragmented, and the thinned portion 135 connecting it to the next fastener in the string was broken so that the driven fastener was no longer connected to the next fastener in the string.

Thus, it will be seen that according to the present invention the automatic feeding of two-piece fasteners to an impacting device has been provided which allows ready refiring of the impacting device to effectively fasten metal sheets together without predrilling holes in the metal sheets. While the invention has been herein shown and described in what is presently conceived to be a preferred and practical embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A powered impacting device comprising:

a handle elongated in a direction of elongation; a first, inner piston; a second, outer, piston concentric with said first piston; means for receipt of a two-piece fastener, having concentric inner and outer components, in operative relationship with said pistons so that said outer component is driven by said second piston, and said inner component is driven by said first piston; and means for supplying actuating fluid to said pistons so that said second piston contacts said outer component and drives it axially in a given direction, and then said first piston contacts said inner component and drives it axially in the same direction, moving relative to said second piston, wherein the improvement comprises a handle safety mechanism for preventing supply of actuating fluid to said pistons unless said handle safety mechanism is positively rotated about an axis parallel to said handle direction of elongation against spring pressure provided by spring means.

2. A device as recited in claim 1 further comprising a trigger for effecting operation of said means for supplying pressurized fluid to said pistons; and wherein said handle safety mechanism includes a cam portion rotatable with said handle for operatively engaging said trigger to prevent movement of said trigger in one position thereof, and to allow movement of said trigger in another position thereof.

3. A device as recited in claim 1 wherein said handle safety mechanism includes a rotatable shaft having a bore formed therein, and wherein the device further comprises rod means having a first end thereof for engaging a surface into which said fasteners are driven, and a second end thereof for entering said bore in said shaft for latching said shaft against rotation; and spring means for biasing said rod means so that said second end thereof will enter said shaft bore to prevent shaft rotation until said first end thereof contacts and is moved by the surface against spring pressure to move said second end out of said shaft bore and allow shaft rotation.

4. A powered impacting device comprising:

a first, inner piston having a fastener abutting portion;

a second, outer piston, concentric with said first piston, having a fastener abutting portion;

means for supplying actuating fluid to said pistons so that they move in a given axial direction;

a cylinder for guiding movement of said second piston in the axial direction, said cylinder having an end face for operatively stopping axial movement of the second piston and comprising means for receipt of a self-piercing two-piece fastener having concentric inner and outer components, in operative relationship with said first and second pistons so that said outer component is driven by said second piston fastener abutting portion to pierce a workpiece, and said inner component is driven by said first piston fastener abutting portion to effect locking of said outer component with said workpiece;

said cylinder including movable wall portions operatively associated therewith for receiving two-piece fasteners and for positioning them to be impacted by said pistons; and means for automatically feeding said fasteners to said movable wall portions.

5. A device as recited in claim 4 wherein said end face has cutouts formed therein adjacent a bore therethrough, said bore being disposed in alignment with said pistons and for receiving said fasteners therein, and wherein said movable wall portions are disposed in said cutouts to provide border portions of said bore and are always disposed radially outwardly of said second piston fastener abutting portion so as not to engage said second piston fastener abutting portion.

6. A device as recited in claim 5 wherein said end face further includes a substantially radial grooved passageway formed therein for guiding fasteners to said movable wall portions from points radially exterior of said end face.

7. A device as recited in claim 6 further comprising means defining passageways operatively communicating with said bore to allow passage away from said bore of frangible material associated with said fasteners.

8. A device as recited in claim 6 wherein said movable wall portions include cam means formed thereon for engaging a fastener passing from said grooved passageway so that said movable wall portions will be cammed out of interfering engagement with said fastener and allow passage thereof into operative association with said bore.

9. A device as recited in claim 5 wherein first and second movable wall portions are provided, each of said movable wall portions comprising pivot means for mounting the respective movable wall portion for pivotal movement about an axis parallel to said bore, and spring means for biasing the respective movable wall portion for movement about its axis toward the other movable wall portion; and wherein cam means are formed on each of said movable wall portions on portions thereof located between parallel planes passing through said pivot means of said first and second wall portions and substantially equi-distant from, and disposed on either side of a line extending through the center of said bore perpendicular to said end face.

10. A device as recited in claim 5 wherein said cutouts are completely contained within the circumferential extent of said end face.

11. A powered impacting device comprising:

a first, inner piston; a second, outer piston concentric with said first piston; means for receipt of a two-piece fastener, having concentric inner and outer components, in operative relationship with said pistons so that said outer component is driven by said second piston, and said inner component is driven by said first piston; and means for supplying pressurized fluid to said pistons so that said second piston contacts said outer component and drives it axially, and said first piston contacts said inner component and drives it axially in the same direction as said outer component, while moving relative to said second piston;

means automatically feeding two-piece fasteners to said means for receipt of two-piece fasteners, said feeding means including a magazine having a shuttle disposed therein; a guide track formed in said magazine for positively maintaining and guiding said fasteners, said shuttle having substantially the same cross-sectional configuration as said guide track; and means for operatively connecting said shuttle to said means for supplying actuating fluid to said pistons; and a quick exhaust shuttle valve means operatively associated with said magazine for effecting quick pneumatic actuation and automatic return of said shuttle when actuating fluid is applied to said shuttle.

12. A device as recited in claim 11 wherein said means for automatically feeding fasteners further comprises an end face structure of said device for operatively stopping axial movement of said second piston; a radial guide track formed in said end face structure and extending from said magazine guide track to a central portion of said end face structure; and movable wall portions of said end face structure for automatically receiving fasteners and for positioning them to be impacted by said pistons, and said movable wall portions being mounted so that they are not engaged by said pistons.

13. A device as recited in claim 24 wherein said means for operatively connecting said shuttle to said means for supplying fluid to said pistons comprises: a common actuating piston having high and low pressure faces, and for actuating said first and second pistons; means for connecting said means for supplying actuating fluid to said common piston high-pressure face; a fluid conduit operatively leading from the low pressure face of said common piston to said magazine; and a check valve disposed in said fluid conduit to allow passage of fluid toward said magazine, but not from said magazine.

14. A powered impacting device comprising:

a handle; a first, inner piston; a second, outer, piston concentric with said first piston; means for receipt of a two-piece fastener, having concentric inner and outer components, in operative relationship with said pistons so that said outer component is driven by said second piston, and said inner component is driven by said first piston; and means for supplying actuating fluid to said pistons so that said second piston contacts said outer component and drives it axially in a given direction, and then said first piston contacts said inner component and drives it axially in the same direction, moving relative to said second piston; a handle safety mechanism for preventing supply of actuating fluid to said pistons unless said handle safety mechanism is positively rotated against spring pressure provided by spring means; a trigger for effecting operation of said means for supplying actuating fluid to said pistons; and wherein said handle safety mechanism includes a cam portion rotatable with said handle for operatively engaging said trigger to prevent movement of said trigger in one position thereof, and to allow movement of said trigger in another position thereof.

15. A powered impacting device comprising:

a handle, a first, inner piston; a second, outer, piston concentric with said first piston; means for receipt of a two-piece fastener, having concentric inner and outer components, in operative relationship with said pistons so that said outer component is driven by said second piston, and said inner component is driven by said first piston; and means for supplying actuating fluid to said pistons so that said second piston contacts said outer component and drives it axially in a given direction, and then said first piston contacts said inner component and drives it axially in the same direction, moving relative to said second piston; a handle safety mechanism for preventing supply of actuating fluid to said pistons unless said handle safety mechanism is positively rotated against spring pressure provided by first spring means; and wherein said handle safety mechanism includes a rotatable shaft having a bore formed therein, and wherein the device further comprises rod means having a first end thereof for engaging a surface into which said fasteners are driven, and a second end thereof for entering said bore in said shaft for latching said shaft against rotation; and second spring means for biasing said rod means so that said second end thereof will enter said shaft bore to prevent shaft rotation until said first end thereof contacts and is moved by the surface against spring pressure provided by said second spring means to move said second end out of said shaft bore and allow shaft rotation.

16. A powered impacting device comprising:

a first, inner piston; a second, outer, piston concentric with said first piston; means for receipt of a two-piece fastener, having concentric inner and outer components, in operative relationship with said pistons so that said outer component is driven by said second piston, and said inner component is driven by said first piston; and means for supplying pressurized fluid to said pistons so that said second piston contacts said outer component and drives it axially, and said first piston contacts said inner component and drives it axially in the same direction as said outer component, while moving relative to said second piston;

means for automatically feeding two-piece fasteners to said means for receipt of two-piece fasteners, and feeding means including a magazine having a shuttle disposed therein; a guide track formed in said magazine for positively maintaining and guiding said fasteners, said shuttle having substantially the same cross-sectional configuration as said guide track; and means for operatively connecting said shuttle to said means for supplying actuating fluid to said pistons; and wherein said means for automatically feeding fasteners further comprises an end face structure of said device for operatively stopping axial movement of said second piston; a radial guide track formed in said end face structure and extending from said magazine guide track to a central portion of said end face structure; and movable wall portions of said end face structure for automatically receiving fasteners and for positioning them to be impacted by said pistons, and said movable wall portions being mounted so that they are not engaged by said pistons.

17. A device as recited in claim 16 wherein said movable wall portions include cam faces mounted for pivotal movement about axes parallel to the direction of movement of said pistons, and wherein said movable wall portions are spring-biased to a first position wherein they are spaced slightly from each other, and are movable against the bias to a second position wherein they are spaced widely from each other.

18. A powered impacting device comprising:

a first, inner piston; a second, outer, piston concentric with said first piston; means for receipt of a two-piece fastener, having concentric inner and outer components, in operative relationship with said pistons so that said outer component is driven by said second piston, and said inner component is driven by said first piston; and means for supplying pressurized fluid to said pistons so that said second piston contacts said outer component and drives it axially, and said first piston contacts said inner component and drives it axially in the same direction as said outer component, while moving relative to said second piston;

means for automatically feeding two-piece fasteners to said means for receipt of two-piece fasteners, said means including a magazine having a shuttle disposed therein; a guide track formed in said magazine for positively maintaining and guiding said fasteners, said shuttle having substantially the same cross-sectional configuration as said guide track; and means for operatively connecting said shuttle to said means for supplying actuating fluid to said pistons; and wherein said means for operatively connecting said shuttle to said means for supplying fluid to said pistons comprises: a common actuating piston having high and low pressure faces, and for actuating said first and second pistons; means for connecting said means for supplying actuating fluid to said common piston high-pressure face; a fluid conduit operatively leading from the low pressure face of said common piston to said magazine; and a check valve disposed in said fluid conduit to allow passage of fluid toward said magazine, but not from said magazine.

* * * * *